US010969143B2

(12) United States Patent
Foley et al.

(10) Patent No.: US 10,969,143 B2
(45) Date of Patent: Apr. 6, 2021

(54) METHOD FOR DETECTING A NON-CLOSING WATER HEATER MAIN GAS VALVE

(71) Applicant: Ademco Inc., Golden Valley, MN (US)

(72) Inventors: Adam Foley, Blaine, MN (US); John D. Mitchell, Maple Grove, MN (US); Rolf L. Strand, Crystal, MN (US); Timothy J. Smith, Minneapolis, MN (US)

(73) Assignee: Ademco Inc., Golden Valley, MN (US)

( * ) Notice: Subject to any disclaimer, the term of this patent is extended or adjusted under 35 U.S.C. 154(b) by 75 days.

(21) Appl. No.: 16/433,219

(22) Filed: Jun. 6, 2019

(65) Prior Publication Data

US 2020/0386446 A1 Dec. 10, 2020

(51) Int. Cl.

| | |
|---|---|
| ***F24H 1/18*** | (2006.01) |
| ***G05D 23/19*** | (2006.01) |
| ***F24H 9/20*** | (2006.01) |

(52) U.S. Cl.

CPC ..... *F24H 9/2035* (2013.01)

(58) Field of Classification Search

CPC ..... F24H 9/2035; F24H 1/186; F24H 1/18; F24H 9/2021; G05D 23/19; G05D 23/1951

See application file for complete search history.

(56) References Cited

U.S. PATENT DOCUMENTS

| | | | |
|---|---|---|---|
| 2,331,718 | A | 10/1943 | Newton |
| 2,920,126 | A | 1/1960 | Hajny |
| 3,272,432 | A | 9/1966 | Davidson |
| 3,759,279 | A | 9/1973 | Smith, Jr. |
| 3,833,428 | A | 9/1974 | Snyder et al. |
| 3,847,350 | A | 11/1974 | Thompson |
| 3,849,350 | A | 11/1974 | Matsko |
| 3,909,816 | A | 9/1975 | Teeters |
| 3,948,439 | A | 4/1976 | Heeger |
| 4,127,380 | A | 11/1978 | Straitz, III |
| 4,131,413 | A | 12/1978 | Ryno |
| 4,204,833 | A | 5/1980 | Kmetz et al. |

(Continued)

FOREIGN PATENT DOCUMENTS

| | | | |
|---|---|---|---|
| CA | 2158120 | A1 | 3/1997 |
| CN | 201772614 | U | 3/2011 |

(Continued)

OTHER PUBLICATIONS

"Results and Methodology of the Engineering Analysis for Residential Water Heater Efficiency Standards," 101 pages, Oct. 1998.

(Continued)

*Primary Examiner* — Gregory A Wilson

(74) *Attorney, Agent, or Firm* — Shumaker & Sieffert, P.A.

(57) ABSTRACT

A water heater may be configured to detect a possible main gas valve non-closure condition in which the sensed water temperature continues to rise while a thermopile signal reaches a stable state. When the possible main gas valve non-closure condition is detected, the controller may be configured to toggle the main gas valve ON and determine whether the thermopile signal from the thermopile changes from the stable state or not by at least a predetermined amount.

20 Claims, 3 Drawing Sheets

(56) References Cited

U.S. PATENT DOCUMENTS 4,221,557 A 9/1980 Jalics
4,305,547 A 12/1981 Cohen
4,324,207 A 4/1982 Leuthard
4,324,944 A 4/1982 Weihrich et al.
RE30,936 E 5/1982 Kmetz et al.
4,333,002 A 6/1982 Kozak
4,421,062 A 12/1983 Pallida, Sr.
4,438,728 A 3/1984 Fracaro
4,467,178 A 8/1984 Swindle
4,483,672 A 11/1984 Wallace et al.
4,507,938 A 4/1985 Hama et al.
4,508,261 A 4/1985 Blank
4,511,790 A 4/1985 Kozak
4,568,821 A 2/1986 Boe
4,588,875 A 5/1986 Kozak et al.
4,638,789 A 1/1987 Ueki et al.
4,655,705 A 4/1987 Shute et al.
4,692,598 A 9/1987 Yoshida et al.
4,696,639 A 9/1987 Bohan, Jr.
4,734,658 A 3/1988 Bohan, Jr.
4,742,210 A 5/1988 Tsuchiyama et al.
4,770,629 A 9/1988 Bohan, Jr.
4,778,378 A 10/1988 Dolnick et al.
4,830,601 A 5/1989 Dahlander et al.
4,834,284 A 5/1989 Vandermeyden
4,906,337 A 3/1990 Palmer
4,965,232 A 10/1990 Mauleon et al.
4,977,885 A 12/1990 Herweyer et al.
4,984,981 A 1/1991 Pottebaum
4,986,468 A 1/1991 Deisinger
5,007,156 A 4/1991 Hurtgen
5,037,291 A 8/1991 Clark
5,077,550 A 12/1991 Cormier
5,103,078 A 4/1992 Boykin et al.
5,112,217 A 5/1992 Ripka et al.
5,125,068 A 6/1992 McNair et al.
5,126,721 A 6/1992 Butcher et al.
5,222,888 A 6/1993 Jones et al.
5,232,582 A 8/1993 Takahashi et al.
5,236,328 A 8/1993 Tate et al.
5,280,802 A 1/1994 Comuzie, Jr.
5,312,036 A 5/1994 Trotter
5,317,670 A 5/1994 Elia
5,391,074 A 2/1995 Meeker
5,424,554 A 6/1995 Marran et al.
5,442,157 A 8/1995 Jackson
5,567,143 A 10/1996 Servidio
5,622,200 A 4/1997 Schulze
5,660,328 A 8/1997 Momber
5,779,143 A 7/1998 Michaud et al.
5,791,890 A 8/1998 Maughan
5,797,358 A 8/1998 Brandt et al.
5,857,845 A 1/1999 Paciorek
5,896,089 A 4/1999 Bowles
5,968,393 A * 10/1999 Demaline ..... G05D 23/1904 219/485
5,971,745 A 10/1999 Bassett et al.
5,975,884 A 11/1999 Dugger
6,053,130 A 4/2000 Shellenberger
6,059,195 A 5/2000 Adams et al.
6,069,998 A 5/2000 Barnes et al.
6,075,923 A 6/2000 Wu
6,080,971 A 6/2000 Seitz et al.
6,129,284 A 10/2000 Adams et al.
6,208,806 B1 3/2001 Langford
6,212,894 B1 4/2001 Brown et al.
6,236,321 B1 5/2001 Troost, IV
6,261,087 B1 7/2001 Bird et al.
6,271,505 B1 8/2001 Henderson
6,286,464 B1 9/2001 Abraham et al.
6,293,471 B1 9/2001 Stettin et al.
6,299,433 B1 10/2001 Gauba et al.
6,350,967 B1 2/2002 Scott
6,351,603 B2 2/2002 Waithe et al.
6,363,218 B1 3/2002 Lowenstein et al.
6,371,057 B1 4/2002 Henderson
6,375,087 B1 4/2002 Day et al.
6,390,029 B2 5/2002 Alphs
RE37,745 E 6/2002 Brandt et al.
6,410,842 B1 6/2002 McAlonan
6,455,820 B2 9/2002 Bradenbaugh
6,553,946 B1 4/2003 Abraham et al.
6,560,409 B2 5/2003 Troost, IV
6,606,968 B2 8/2003 Iwama et al.
6,629,021 B2 9/2003 Cline et al.
6,631,622 B1 10/2003 Ghent et al.
6,633,726 B2 10/2003 Bradenbaugh
6,684,821 B2 2/2004 Lannes et al.
6,701,874 B1 3/2004 Schultz et al.
6,732,677 B2 5/2004 Donnelly et al.
6,794,771 B2 9/2004 Orloff
6,795,644 B2 9/2004 Bradenbaugh
6,835,307 B2 12/2004 Talbert et al.
6,845,110 B2 1/2005 Gibson
6,861,621 B2 3/2005 Ghent
6,880,493 B2 4/2005 Clifford
6,920,377 B2 7/2005 Chian
6,934,862 B2 8/2005 Sharood et al.
6,936,798 B2 8/2005 Moreno
6,955,301 B2 10/2005 Munsterhuis et al.
6,959,876 B2 11/2005 Chian et al.
6,967,565 B2 11/2005 Lingemann
6,973,819 B2 12/2005 Ruhland et al.
6,995,301 B1 2/2006 Shorrosh
7,032,542 B2 4/2006 Donnelly et al.
7,065,431 B2 6/2006 Patterson et al.
7,076,373 B1 7/2006 Munsterhuis et al.
7,088,238 B2 8/2006 Karaoguz et al.
7,103,272 B2 9/2006 Baxter
7,117,825 B2 10/2006 Phillips
7,137,373 B2 11/2006 Seymour, II et al.
7,162,150 B1 1/2007 Welch et al.
7,167,813 B2 1/2007 Chian et al.
7,221,862 B1 5/2007 Miller et al.
7,252,502 B2 8/2007 Munsterhuis
7,255,285 B2 8/2007 Troost et al.
7,298,968 B1 11/2007 Boros et al.
7,314,370 B2 1/2008 Chian et al.
7,317,265 B2 1/2008 Chian et al.
7,346,274 B2 3/2008 Bradenbaugh
7,373,080 B2 5/2008 Baxter
7,380,522 B2 6/2008 Krell et al.
7,432,477 B2 10/2008 Teti
7,434,544 B2 10/2008 Donnelly et al.
7,469,550 B2 12/2008 Chapman, Jr. et al.
7,497,386 B2 3/2009 Donnelly et al.
7,506,617 B2 3/2009 Paine
7,526,539 B1 4/2009 Hsu
7,561,057 B2 7/2009 Kates
7,603,204 B2 10/2009 Patterson et al.
7,613,855 B2 11/2009 Phillips et al.
7,623,771 B2 11/2009 Lentz et al.
7,634,976 B2 12/2009 Gordon et al.
7,672,751 B2 3/2010 Patterson et al.
7,712,677 B1 5/2010 Munsterhuis et al.
7,744,007 B2 6/2010 Beagen et al.
7,744,008 B2 6/2010 Chapman, Jr. et al.
7,770,807 B2 8/2010 Robinson et al.
7,798,107 B2 9/2010 Chian et al.
7,804,047 B2 9/2010 Zak et al.
7,818,095 B2 10/2010 Hotton et al.
7,902,959 B2 3/2011 Yamada et al.
7,932,480 B2 4/2011 Gu et al.
7,934,662 B1 5/2011 Jenkins
7,970,494 B2 6/2011 Fima
7,974,527 B1 7/2011 Adler
8,061,308 B2 11/2011 Phillips
8,074,894 B2 12/2011 Beagen
8,083,104 B2 12/2011 Roetker et al.
8,111,980 B2 2/2012 Bradenbaugh
8,165,726 B2 4/2012 Nordberg et al.
8,204,633 B2 6/2012 Harbin et al.
8,245,987 B2 8/2012 Hazzard et al.
8,322,312 B2 12/2012 Strand

(56) References Cited

U.S. PATENT DOCUMENTS

| | | | | |
|---|---|---|---|---|
| 8,360,334 | B2 | 1/2013 | Nold et al. | |
| 8,367,984 | B2 | 2/2013 | Besore | |
| 8,422,870 | B2 | 4/2013 | Nelson et al. | |
| 8,485,138 | B2 | 7/2013 | Leeland | |
| 8,498,527 | B2 | 7/2013 | Roetker et al. | |
| 8,600,556 | B2 | 12/2013 | Nesler et al. | |
| 8,606,092 | B2 | 12/2013 | Amiran et al. | |
| 8,660,701 | B2 | 2/2014 | Phillips et al. | |
| 8,667,112 | B2 | 3/2014 | Roth et al. | |
| 8,726,789 | B2 | 5/2014 | Clark | |
| 8,770,152 | B2 | 7/2014 | Leeland et al. | |
| 9,080,769 | B2 | 7/2015 | Bronson et al. | |
| 9,122,283 | B2 | 9/2015 | Rylski et al. | |
| 9,195,242 | B2 | 11/2015 | Zobrist et al. | |
| 9,228,746 | B2 | 1/2016 | Hughes et al. | |
| 9,249,986 | B2 | 2/2016 | Hazzard et al. | |
| 9,268,342 | B2 | 2/2016 | Beyerle et al. | |
| 9,310,098 | B2 | 4/2016 | Buescher et al. | |
| 9,435,566 | B2 * | 9/2016 | Hill | F24H 1/186 |
| 9,797,600 | B2 | 10/2017 | Barels | |
| 10,151,484 | B2 * | 12/2018 | Prichard | F24H 1/186 |
| 10,345,007 | B2 * | 7/2019 | Hill | F24H 9/2021 |
| 2002/0099474 | A1 | 7/2002 | Khesin | |
| 2003/0093186 | A1 | 5/2003 | Patterson et al. | |
| 2004/0042772 | A1 | 3/2004 | Whitford et al. | |
| 2004/0079749 | A1 | 4/2004 | Young et al. | |
| 2006/0027571 | A1 | 2/2006 | Miyoshi et al. | |
| 2006/0272830 | A1 | 12/2006 | Fima | |
| 2007/0023333 | A1 | 2/2007 | Mouhebaty et al. | |
| 2007/0210177 | A1 | 9/2007 | Karasek | |
| 2007/0292810 | A1 | 12/2007 | Maiello et al. | |
| 2008/0003530 | A1 | 1/2008 | Donnelly et al. | |
| 2008/0023564 | A1 | 1/2008 | Hall | |
| 2008/0048046 | A1 | 2/2008 | Wagner et al. | |
| 2008/0197206 | A1 | 8/2008 | Murakami et al. | |
| 2009/0117503 | A1 | 5/2009 | Cain | |
| 2009/0191495 | A1 | 7/2009 | Guzorek | |
| 2010/0065764 | A1 | 3/2010 | Canpolat | |
| 2010/0163016 | A1 | 7/2010 | Pan | |
| 2011/0254661 | A1 | 10/2011 | Fawcett et al. | |
| 2011/0259322 | A1 | 10/2011 | Davis et al. | |
| 2011/0277706 | A1 | 11/2011 | Arnold et al. | |
| 2011/0305444 | A1 | 12/2011 | Pussell | |
| 2012/0060771 | A1 | 3/2012 | Brian et al. | |
| 2012/0060829 | A1 | 3/2012 | DuPlessis et al. | |
| 2012/0276488 | A1 | 11/2012 | Virag et al. | |
| 2013/0104814 | A1 | 5/2013 | Reyman | |
| 2014/0202549 | A1 | 7/2014 | Hazzard et al. | |
| 2014/0203093 | A1 | 7/2014 | Young et al. | |
| 2014/0212821 | A1 | 7/2014 | Banu et al. | |
| 2015/0083384 | A1 | 3/2015 | Lewis, Jr. et al. | |
| 2015/0120067 | A1 | 4/2015 | Wing et al. | |
| 2015/0276268 | A1 | 10/2015 | Hazzard et al. | |
| 2015/0277463 | A1 | 10/2015 | Hazzard et al. | |
| 2015/0354833 | A1 | 12/2015 | Kreutzman | |
| 2016/0260312 | A1 | 9/2016 | Hazzard et al. | |
| 2016/0305827 | A1 | 10/2016 | Heil et al. | |
| 2016/0342163 | A1 | 11/2016 | Hazzard et al. | |
| 2018/0100672 | A1 | 4/2018 | Smith et al. | |

FOREIGN PATENT DOCUMENTS

| | | | |
|---|---|---|---|
| CN | 201909441 | U | 7/2011 |
| CN | 102213489 | A | 10/2011 |
| CN | 203203717 | U | 9/2013 |
| EP | 0356609 | A1 | 3/1990 |
| EP | 0531072 | A1 | 3/1993 |
| EP | 0699316 | B1 | 7/1999 |
| EP | 0967440 | A2 | 12/1999 |
| EP | 1148298 | B1 | 10/2004 |
| EP | 1621814 | A2 | 2/2006 |
| EP | 1178748 | B1 | 10/2006 |
| EP | 2108140 | B1 | 6/2012 |
| FR | 2820206 | A1 | 8/2002 |
| GB | 2211331 | A | 6/1989 |
| JP | 07269854 | A | 10/1995 |
| JP | 08264469 | A | 10/1996 |
| JP | 2005283039 | A | 10/2005 |
| JP | 2006084322 | A | 3/2006 |
| JP | 2008008548 | A | 1/2008 |
| JP | 2011220560 | A | 4/2011 |
| TW | 1431223 | B | 3/2014 |
| WO | 9718417 | A1 | 5/1997 |
| WO | 2008102263 | A2 | 8/2008 |
| WO | 2009022226 | A2 | 2/2009 |
| WO | 2009061622 | A1 | 5/2009 |
| WO | 2011104592 | A1 | 9/2011 |

OTHER PUBLICATIONS

AO Smith, "IComm Remote Monitoring System, Instruction Manual," 64 pages, Jun. 2009.

U.S. Appl. No. 14/964,392, filed Dec. 9, 2015.

Filibeli et al., "Embedded Web Server-Based Home Appliance Networks," Journal of Network and Computer Applications, vol. 30, pp. 499-514, 2007.

Halfbakery.com, "Hot Water Alarm," 2 pages, Sep. 4, 2002.

Heat Transfer Products Inc., "Specification for Heat Transfer Products, Inc., Vision 3 System," 2 pages, Mar. 17, 2006.

Hiller, "Dual-Tank Water Heating System Options," ASHRAE Transactions: Symposia, pp. 1028-1037, Downloaded Nov. 16, 2012.

Honeywell International Inc., "CS8800 General Assembly, Drawing No. 50000855," 2 pages, Oct. 24, 2008.

Honeywell International Inc., "Thermopile Assembly, Drawing No. 50006821," 1 page, Jun. 18, 2010.

Honeywell International Inc., "Thermopile Element, Drawing No. 50010166," 1 page, Apr. 1, 2005.

Honeywell International Inc., "Thermopile General Assembly, Drawing No. 50006914," 1 page, Jan. 12, 2006.

Honeywell International Inc., Photograph of a CS8800 Thermocouple Assembly, 1 page, saved Oct. 9, 2014.

http://nachi.org/forum/f22/dual-water-heater-installations-36034/, "Dual Water Heater Installation," 10 pages, printed Oct. 1, 2012.

http://www.whirlpoolwaterheaters.com/learn_more/energysmartelectricwaterheateroperation.aspx, link no longer functions, "Energy Smart Electric Water Heater Operation," 3 pages, prior to Nov. 13, 2012.

http://www.whirlpoolwaterheaters.com/learn-more/eletric-water-heaters/6th-sense%E2% . . . , "Whirlpool Energy Smart Electric Water Heater, Learn More," 3 pages, printed Jan. 15, 2015.

Industrial Controls, "Basics of PID Control (Proportional+Integral+Derivative)," downloaded from https://web.archive.org/web/20110206195004/http://wwww.industrialcontrolsonline.com /training/online/basics-pid-control-proportionalintegralderivative, 4 pages, Feb. 6, 2011.

InspectAPedia, "Guide to Alternative Hot Water Sources," 6 pages, printed Oct. 1, 2012.

Johnson Controls, "K Series BASO Thermocouples, Heating Line Product Guide 435.0, Thermocouples Section, Product Bulletin K Series," 8 pages, Oct. 1998.

Lennox, "Network Control Panel, User's Manual," 18 pages, Nov. 1999.

Moog, "M3000 Control System, RTEMP 8, Remote 8-Channel Temperature Controller with CanOpen Interface," 6 pages, Nov. 2004.

Process Technology, "Troubleshooting Electric Immersion Heaters," downloaded from http://www.processtechnology.com/troubleshootheaters.html, 3 pages, Mar. 22, 2010.

Raychem, "HWAT-ECO," Tyco Thermal Control, 4 pages, 2012.

Reliance Water Heaters, "Service Handbook for Standard Residential FVIR Gas Water Heaters, Models: G/LORT, G/LORS, G/LBRT, G/LBRS, G/LBCT, G/LBCS, G/LKRT, G/LKRS, G/LKCT, G/LART, G/LARS, G/LXRT, GLQRT—Series 200/201 and Series 202/203," 44 pages, Nov. 2009.

Techno Mix, "Installation-Series and Parallel," downloaded from www.chinawinds. co.uk/diy_tips/installation_series_and_parallel.html, 5 pages, printed Oct. 1, 2012.

(56) References Cited

OTHER PUBLICATIONS

Triangle Tube, "Prestige Solo Condensing High Efficiency Gas Boiler," 4 pages, revised Apr. 30, 2012.
International Search Report and Written Opinion for PCT Application No. PCT/US2017/055446, dated Jan. 4, 2018.
U.S. Appl. No. 14/689,896, filed Apr. 17, 2015.
U.S. Appl. No. 15/061,520, filed Mar. 4, 2016.
U.S. Appl. No. 15/166,110, filed May 26, 2016.

* cited by examiner

METHOD FOR DETECTING A NON-CLOSING WATER HEATER MAIN GAS VALVE

TECHNICAL FIELD

The present disclosure pertains generally to methods of operating water heaters with a main gas valve and more particularly to methods of detecting a non-closing main gas valve in a water heater.

BACKGROUND

Water heaters are used in homes, businesses and just about any establishment having the need for heated water. A conventional water heater typically has at least one heating element or "heater," such as a gas-fired burner and/or an electric resistive element. Each water heater also typically has at least one thermostat or controller for controlling the heater. The controller often receives signals related to the temperature of the water within the water heater, oftentimes from a temperature sensor that is thermally engaged with the water in the water heater. In some instances, a water heater may operate in accordance with a first temperature set point and a second temperature set point. When temperature signals from the temperature sensor indicate that the water temperature is below a first set point, the controller turns on the gas burner by opening a gas valve and the water within the water heater begins to heat. After some time, the water temperature within the water heater will increase to a second set point, at which point the controller typically causes the gas burner to reduce its heat output by partially closing the gas valve or, alternatively, causes the gas burner to turn off by closing the gas valve. This heat cycle begins again when the water temperature within the water heater drops below the first set point. In some cases, the gas valve may not completely close. A need remains for improved methods for detecting when the gas valve does not completely close.

SUMMARY

The disclosure relates generally to systems for monitoring the performance, and hence the health, of a plurality of water heaters that may be distributed between a plurality of different buildings. In an example of the present disclosure, a water heater system includes a water tank and a main gas burner that is disposed proximate the water tank and is configured to heat water within the water tank. A main gas valve is configured to control a flow of gas to the main burner. A pilot gas burner is disposed proximate the main gas burner such that the pilot gas burner is positioned to ignite the main gas burner. A water temperature sensor is thermally coupled to water within the water tank and outputs a water temperature signal that is representative of a sensed water temperature within the water tank. A thermopile has a first portion that is positioned proximate a pilot flame that is produced by the pilot gas burner and a second portion that is positioned proximate a main burner flame that is produced by the main gas burner. The thermopile outputs a thermopile signal that is representative of a temperature difference between the first portion of the thermopile and the second portion of the thermopile. A controller is operably coupled with the main gas valve and is configured to receive the thermopile signal from the thermopile and the water temperature signal from the water temperature sensor. The controller is configured to cycle the main gas burner ON when the sensed water temperature falls to a temperature set point minus a dead band, and to cycle the main gas burner OFF when the sensed water temperature reaches the temperature set point. After the sensed water temperature reaches the temperature set point, and the controller cycles the main gas burner OFF, the controller is configured to monitor for a possible main gas valve non-closure condition where: (1) the sensed water temperature continues to rise; and (2) the thermopile signal from the thermopile reaches a stable state, and when the possible main gas valve non-closure condition is detected, the controller is configured to toggle the main gas valve ON and determine whether the thermopile signal from the thermopile changes from the stable state or not by at least a predetermined amount.

Another example of the present disclosure is a heating assembly for use with a water heater having a water tank. The heating assembly includes a main gas burner that is configured to heat water within the water tank and a main gas valve that is configured to control a flow of gas to the main gas burner. A pilot gas burner is disposed proximate the main gas burner such that the pilot gas burner is positioned to ignite the main gas burner. A water temperature sensor is configured to be thermally coupled to water within the water tank and outputs a water temperature signal representative of a sensed water temperature within the water tank. A thermopile has a first portion positioned that is proximate a pilot flame produced by the pilot gas burner and a second portion that is positioned proximate a main burner flame produced by the main gas burner and outputs a thermopile signal that is representative of a temperature difference between the first portion of the thermopile and the second portion. A controller is operably coupled with the main gas valve and is configured to receive the thermopile signal from the thermopile and the water temperature signal from the water temperature sensor. The controller is configured to cycle the main gas burner ON when the sensed water temperature falls to a temperature set point minus a dead band, and to cycle the main gas burner OFF when the sensed water temperature reaches the temperature set point. After the sensed water temperature reaches the temperature set point, and the controller cycles the main gas burner OFF, the controller is configured to monitor for a possible main gas valve non-closure condition where: (1) the sensed water temperature continues to rise; and (2) the thermopile signal from the thermopile reaches a stable state, and when the possible main gas valve non-closure condition is detected, the controller is configured to toggle the main gas valve ON and determine whether the thermopile signal from the thermopile changes from the stable state or not by at least a predetermined amount.

Another example of the present disclosure is a control module for a heating assembly of a water heater with a water tank, wherein the heating assembly includes a main gas burner configured to heat water within the water tank, a main gas valve configured to control a flow of gas to the main gas burner, a pilot gas burner disposed proximate the main gas burner such that the pilot gas burner is positioned to ignite the main gas burner, a water temperature sensor configured to be thermally coupled to water within the water tank, the water temperature sensor outputting a water temperature signal representative of a sensed water temperature within the water tank, and a thermopile having a first portion positioned proximate a pilot flame produced by the pilot gas burner and a second portion positioned proximate a main burner flame produced by the main gas burner, the thermopile outputting a thermopile signal that is representative of a temperature difference between the first portion of the thermopile and the second portion. The control module includes an output that is configured to provide control signals to the main gas valve, a first input that is configured to receive the thermopile signal from the thermopile and a second input that is configured to receive the water temperature signal from the water temperature sensor. A controller is operably coupled to the output, the first input and the second input and is configured to cycle the main gas burner ON via the output when the sensed water temperature falls to a temperature set point minus a dead band, and to cycle the main gas burner OFF via the output when the sensed water temperature reaches the temperature set point. After the sensed water temperature reaches the temperature set point, and the controller cycles the main gas burner OFF, the controller is configured to monitor for a possible main gas valve non-closure condition where: (1) the sensed water temperature continues to rise; and (2) the thermopile signal from the thermopile reaches a stable state. When the controller detects the possible main gas valve non-closure condition, the controller is configured to toggle the main gas valve ON via the output and determine whether the thermopile signal from the thermopile changes from the stable state or not by at least a predetermined amount.

The preceding summary is provided to facilitate an understanding of some of the features of the present disclosure and is not intended to be a full description. A full appreciation of the disclosure can be gained by taking the entire specification, claims, drawings, and abstract as a whole.

BRIEF DESCRIPTION OF THE DRAWINGS

The disclosure may be more completely understood in consideration of the following description of various illustrative embodiments of the disclosure in connection with the accompanying drawings, in which.

Figure 1:
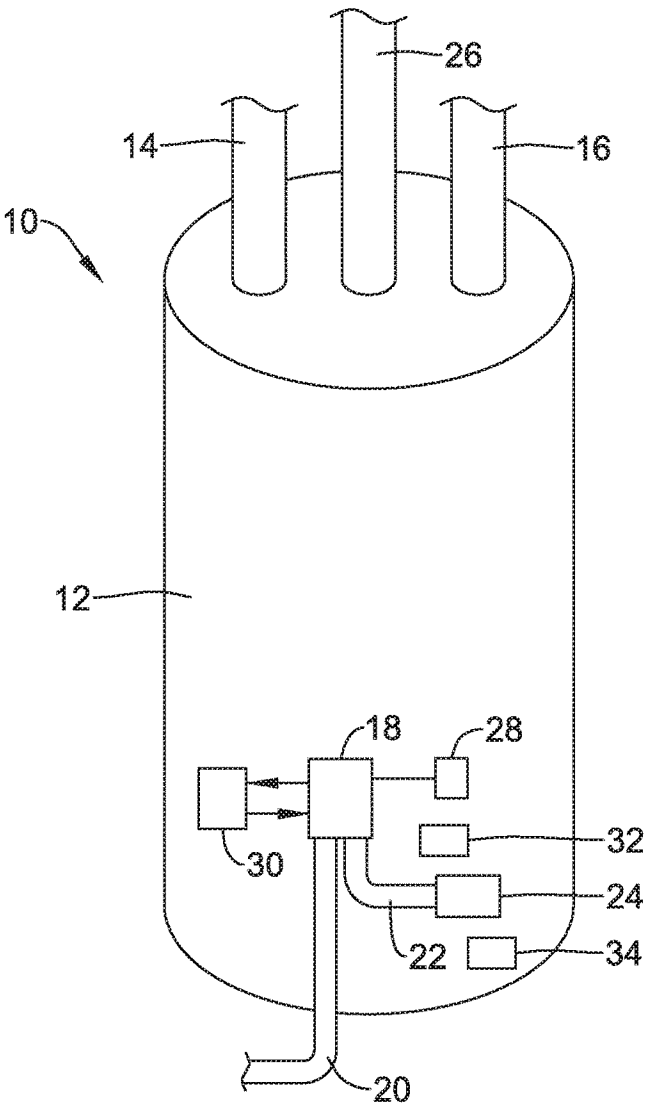
FIG. 1 is a schematic view of an illustrative water heater.

While the disclosure is amenable to various modifications and alternative forms, specifics thereof have been shown by way of example in the drawings and will be described in detail. It should be understood, however, that the intention is not to limit aspects of the disclosure to the particular illustrative embodiments described. On the contrary, the intention is to cover all modifications, equivalents, and alternatives falling within the spirit and scope of the disclosure.

DESCRIPTION

The following description should be read with reference to the drawings wherein like reference numerals indicate like elements. The drawings, which are not necessarily to scale, are not intended to limit the scope of the disclosure. In some of the figures, elements not believed necessary to an understanding of relationships among illustrated components may have been omitted for clarity.

All numbers are herein assumed to be modified by the term "about", unless the content clearly dictates otherwise. The recitation of numerical ranges by endpoints includes all numbers subsumed within that range (e.g., 1 to 5 includes 1, 1.5, 2, 2.75, 3, 3.80, 4, and 5).

As used in this specification and the appended claims, the singular forms "a", "an", and "the" include the plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is contemplated that the feature, structure, or characteristic may be applied to other embodiments whether or not explicitly described unless clearly stated to the contrary.

FIG. 1 provides a schematic view of an illustrative but non-limiting water heater 10. The water heater 10 includes a water tank 12. The water tank 12 may include an insulating layer (not explicitly shown) positioned about the water tank 12 to help reduce thermal losses from the water tank 12. Cold water enters the water tank 12 through a cold water line 14 and is heated by a main burner 24. The resulting heated water exits through a hot water line 16. A main gas valve 18 regulates gas flow from a gas source 20 through a combustion gas line 22 and into the main burner 24. A flue 26 permits combustion byproducts to safely exit. A temperature sensor 28 provides the main gas valve 18 with an indication of a current water temperature within the water tank 12. A pilot burner 34 provides a flame that causes ignition of the main burner 24 when gas is permitted to flow through the combustion gas line 22 and into the main burner 24.

In some cases, the water heater 10 may include a controller 30 that is operably coupled with the main gas valve 18 such that the controller 30 may regulate operation of the gas control unit. In some cases, the water heater 10 may include a thermopile 32 that is operably coupled to a flame produced by the main burner 24 as well as a flame produced by the pilot burner 34. It will be appreciated that the thermopile 32 may output a voltage that is related to a temperature difference across the thermopile 32. While shown schematically, the thermopile 32 may be positioned such that one end or portion of the thermopile 32 may be heated by a flame produced by the main burner 24 while another end or portion of the thermopile 32 may be heated by a flame produced by the pilot burner 34. Accordingly, and in some cases, when the main burner 24 and the pilot burner 34 are both producing a flame, there will be a relatively smaller temperature difference across the thermopile 32, and thus a relatively lower voltage produced by the thermopile 32. Conversely, when for example the pilot burner 34 is producing a flame but the main burner 24 is not, there will be a relatively larger temperature difference across the thermopile 32, and thus a relatively higher voltage produced by the thermopile 32. The thermopile 32 may provide a thermopile signal to the controller 30. In some cases, the thermopile signal may be a voltage signal, for example.

In some cases there may be a desire to confirm that the main burner 24 is actually completely OFF, as in some instances the main gas valve 18 may not completely stop gas flow to the main burner 24 when in the OFF position. For example, sediment may impair operation of a valve within the main gas valve 18. In some instances, flocculants within the water tank 12 may become heated, and then circulate within the water. If the heated flocculants contact the temperature sensor 28, a false temperature reading may occur. In operation, the controller 30 may be configured to cycle the main burner 24 ON by opening the main gas valve 18 when a sensed water temperature falls to a temperature set point minus a dead band, and to cycle the main burner 24 OFF by closing the main gas valve 18 when the sensed water temperature reaches the temperature set point. A dead band is used to prevent the main burner 24 from cycling on and off repeatedly in response to minor water temperature differences reported to the controller 30 via the water temperature sensor 28.

Once the sensed water temperature has reached the temperature set point, and the controller 30 has cycled the main burner 24 OFF in response to reaching the temperature set point, the controller 30 may be configured to monitor for a possible main gas valve non-closure condition in which the sensed water temperature continues to rise and the thermopile signal from the thermopile 32 reaches a stable state as this may indicate that the main burner 24 is still producing heat. This can be an indication that the main gas valve 18 did not completely close when directed to do so by the controller 30. When a possible main gas valve non-closure condition is detected, the controller 30 may be configured to toggle the main gas valve 18 ON and determine whether the thermopile signal from the thermopile 32 changes from the stable state or not by at least a predetermined amount. The value of the predetermined amount may be factory set, for example, and may represent a change in the thermopile signal from the thermopile 32 that varies by more than ten percent, more than twenty percent, and so on.

If the main gas valve 18 is working properly, toggling the main gas valve 18 ON will cause the water temperature within the water tank 12 to increase, and will cause the thermopile signal from the thermopile 32 to indicate a decreased temperature differential across the thermopile 32. If the main gas valve 18 is stuck open, togging the main gas valve 18 ON will have little or no effect on either the water temperature or the thermopile output from the thermopile 32.

In some cases, when the controller 30 detects a possible main gas valve non-closure condition, the controller 30 may be configured to toggle the main gas valve 18 ON for a predetermined period of time before toggling the main gas valve 18 OFF. The controller 30 may be configured to toggle the main gas valve 19 ON for a predetermined period of time, regardless of whether there is a call for heat before toggling the main gas valve 18 OFF. The pilot burner 34 may be a pilot light that is burning at all times. In some instances, the pilot burner 34 may instead be an intermittent pilot that is turned ON when the controller 30 is monitoring for a possible main gas valve non-closure condition. When a possible main gas-valve non-closure condition is detected, the controller 30 may be configured to issue an alert. This may be as simple as triggering a flashing light error code on the water heater 10 itself. In some cases, if the controller 30 is able to communicate with other devices such as via Bluetooth or WiFi, the controller 30 may transmit an alert to another device such as a homeowner's cell phone, for example.

In some cases, if the thermopile signal from the thermopile 32 changes from the stable state by the predetermined amount, the controller 30 may be configured to take one or more actions in response. For example, the controller 30 may lower a temperature set point. The controller 30 may increase a temperature cutoff temperature (TCO) at which point the controller 30 shuts down the main gas valve 18 after the sensed water temperature reaches the TCO. The controller 30 may increase the time that the sensed water temperature must remain above the TCO before the controller 30 shuts down the main gas valve 18. When the thermopile signal from the thermopile 32 does not change from the stable state by the predetermined amount, the controller 30 may be configured to shut down the main gas valve 18.

In some cases, the controller 30 may be further configured to store a steady state ON value for the thermopile signal at a time when the main gas burner 18 is ON for an extended time and to store a steady state OFF value for the thermopile signal at a time when the main gas burner is 18 OFF for an extended time with only the pilot gas burner 18 ON. The controller 30 may be configured to use the steady state OFF value and the steady state ON value to interpolate and/or extrapolate to a current position of the main gas valve 18 based on the current thermopile signal. The controller 30 may be further configured to periodically update the steady state ON value and the steady state OFF value in order to compensate for water heater performance changes over time.

Figure 2:
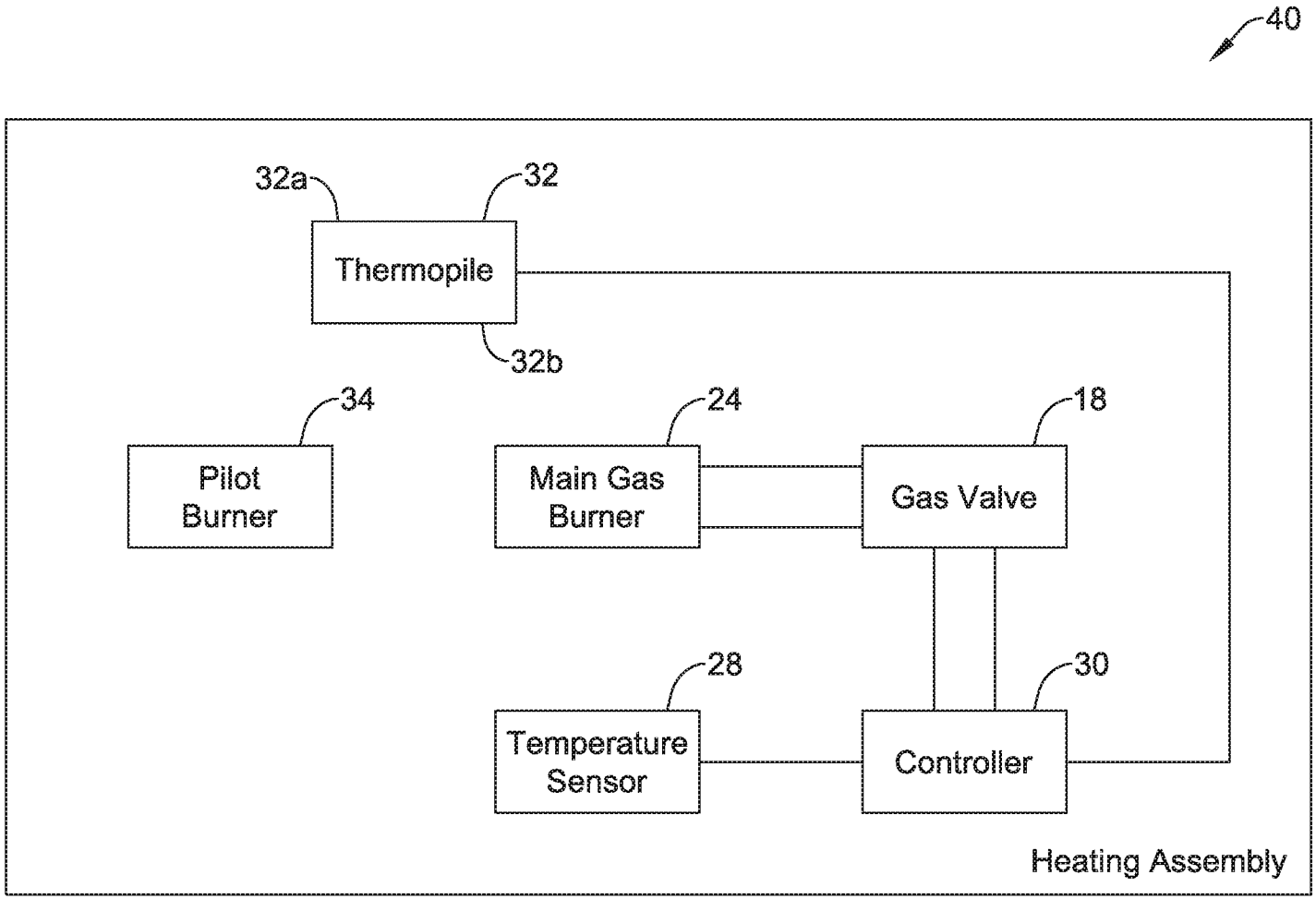
FIG. 2 is a schematic block diagram of a heating assembly usable with a water heater such as the illustrative water heater of FIG. 1.

FIG. 2 is a schematic block diagram of a heating assembly 40 that may be used with a water heater having a water tank, such as but not limited to the water heater 10 shown in FIG. 1. The main gas valve 18 is configured to control a flow of gas to the main burner 24. The pilot burner 34 is disposed proximate the main burner 24 such that the pilot burner 34 is positioned to ignite the main burner 24. The water temperature sensor 28 is configured to be thermally coupled to water within the water tank and is configured to output a water temperature signal that is representative of a sensed water temperature within the water tank. The thermopile 32 may have a first portion 32*a* that is positioned proximate a pilot flame produced by the pilot burner 34 and a second portion 32*b* that is positioned proximate a main burner flame produced by the main burner 24. The thermopile 32 is configured to output a thermopile signal that is representative of a temperature difference between the first portion 32*a* of the thermopile 32 and the second portion 32*b* of the thermopile 32.

The controller 30 is operably coupled with the main gas valve 18 and is configured to receive the thermopile signal from the thermopile 32 and the water temperature signal from the water temperature sensor 28. In some instances, the controller 30 may be configured to cycle the main gas burner 18 ON when the sensed water temperature falls to a temperature set point minus a dead band, and to cycle the main gas burner 18 OFF when the sensed water temperature reaches the temperature set point. The controller 30 may be configured to monitor for a possible main gas valve non-closure condition in which the sensed water temperature continues to rise while the thermopile signal from the thermopile reaches a stable state. When this occurs, the controller 30 is configured to toggle the main gas valve 18 ON and determine whether the thermopile signal from the thermopile 32 changes from the stable state or not by at least a predetermined amount.

Figure 3:
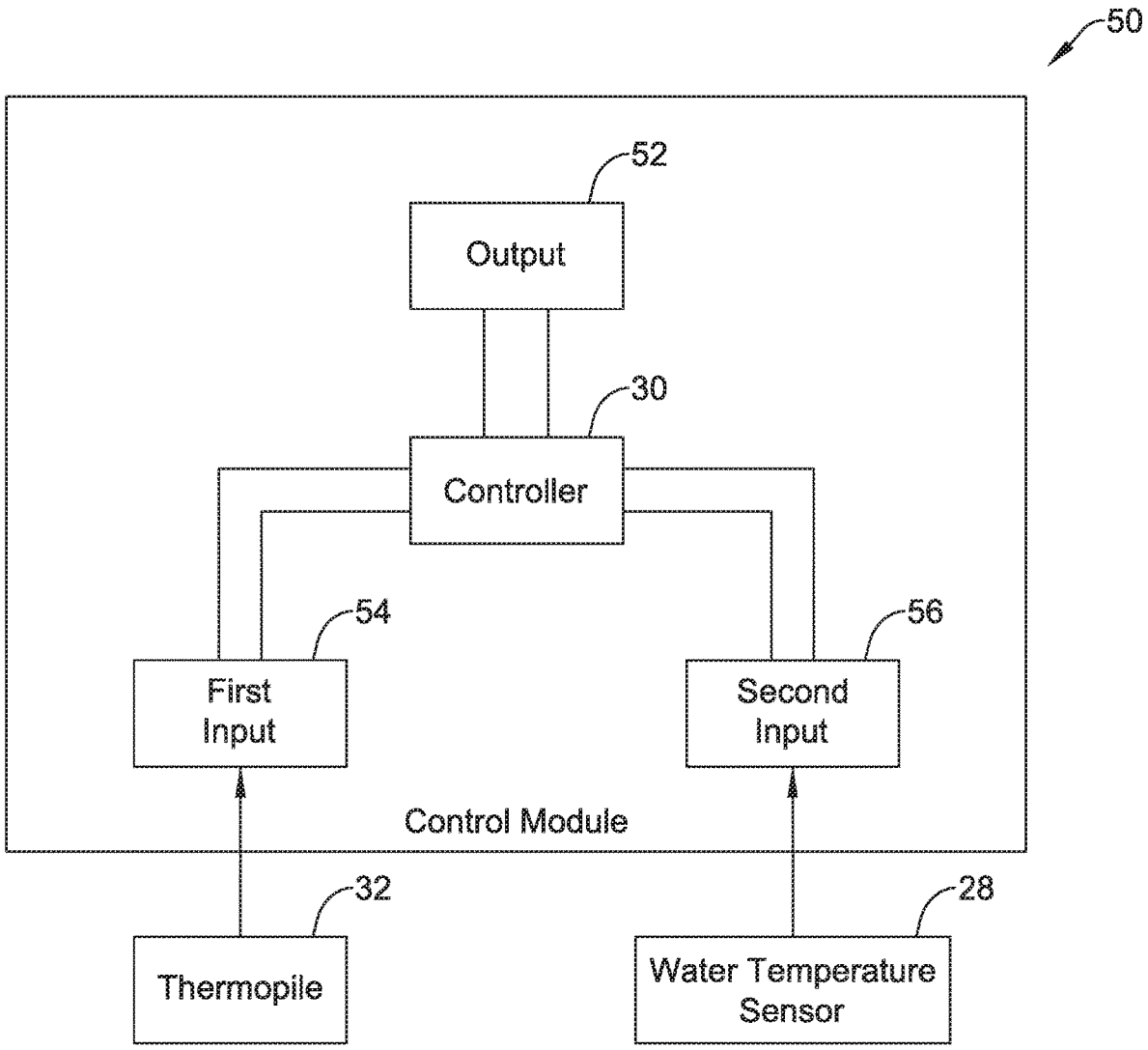
FIG. 3 is a schematic block diagram of a control module usable with a heating assembly such as the illustrative heating assembly of FIG. 2.

FIG. 3 is a schematic block diagram of a control module 50 that may be used as part of a heating assembly such as but not limited to the heating assembly of FIG. 2. The control module 50 includes an output 52 that is configured to provide control signals to the main gas valve 18. A first input 54 is configured to receive a thermopile signal from the thermopile 32 and a second input 56 is configured to receive a water temperature signal from the water temperature sensor 28. The controller 30 is operably coupled to the output 52, the first input 54 and the second input 56 and is configured to operate the main gas valve 18 as discussed with respect to FIGS. 1 and 2. The controller 30 is also configured to monitor for and respond to any possible main gas valve non-closure conditions as discussed with respect to FIGS. 1 and 2.

Those skilled in the art will recognize that the present disclosure may be manifested in a variety of forms other than the specific embodiments described and contemplated herein. Accordingly, departure in form and detail may be made without departing from the scope and spirit of the present disclosure as described in the appended claims.

What is claimed is:

1. A water heater system comprising:

a water tank;

a main gas burner disposed proximate the water tank and configured to heat water within the water tank;

a main gas valve configured to control a flow of gas to the main gas burner;

a pilot gas burner disposed proximate the main gas burner such that the pilot gas burner is positioned to ignite the main gas burner;

a water temperature sensor thermally coupled to water within the water tank, the water temperature sensor outputting a water temperature signal representative of a sensed water temperature within the water tank;

a thermopile having a first portion positioned proximate a pilot flame produced by the pilot gas burner and a second portion positioned proximate a main burner flame produced by the main gas burner, the thermopile outputting a thermopile signal that is representative of a temperature difference between the first portion of the thermopile and the second portion;

a controller operably coupled with the main gas valve and configured to receive the thermopile signal from the thermopile and the water temperature signal from the water temperature sensor, the controller configured to cycle the main gas burner ON when the sensed water temperature falls to a temperature set point minus a dead band, and to cycle the main gas burner OFF when the sensed water temperature reaches the temperature set point;

wherein after the sensed water temperature reaches the temperature set point, and the controller cycles the main gas burner OFF, the controller is configured to monitor for a possible main gas valve non-closure condition where: (1) the sensed water temperature continues to rise; and (2) the thermopile signal from the thermopile reaches a stable state, and when the possible main gas valve non-closure condition is detected, the controller is configured to toggle the main gas valve ON and determine whether the thermopile signal from the thermopile changes from the stable state or not by at least a predetermined amount.

2. The water heater system of claim 1, wherein:

when the thermopile signal from the thermopile changes from the stable state by at least the predetermined amount, the controller is configured to: (1) lower the temperature set point; (2) increase a temperature cutoff temperature (TCO) in which the controller shuts down the main gas valve after the sensed water temperature reaches the TCO; and/or (3) increase the time that the sensed water temperature must remain above the TCO before the controller shuts down the main gas valve; and when the thermopile signal from the thermopile does not change from the stable state by the predetermined amount, the controller is configured to shut down the main gas valve.

3. The water heater system of claim 1, wherein when the possible main gas valve non-closure condition is detected, the controller is configured to toggle the main gas valve ON for a predetermined period of time before toggling the main gas valve OFF.

4. The water heater system of claim 1, wherein when the possible main gas valve non-closure condition is detected, the controller is configured to toggle the main gas valve ON for a predetermined period of time regardless of whether there is a call for heat before toggling the main gas valve OFF.

5. The water heater system of claim 1, wherein the pilot gas burner comprises an intermittent pilot, and wherein the intermittent pilot is turned ON when the controller is monitoring for the possible main gas valve non-closure condition.

6. The water heater system of claim 1, wherein the controller is further configured to:

store a steady state ON value for the thermopile signal at a time when the main gas burner is ON for an extended time;

store a steady state OFF value for the thermopile signal at a time when the main gas burner is OFF for an extended time with only the pilot gas burner ON;

use the steady state OFF value and the steady state ON value to interpolate and/or extrapolate to a current position of the main gas valve based on the current the thermopile signal.

7. The water heater system of claim 6, wherein the controller is further configured to periodically update the steady state ON value and the steady state OFF value in order to compensate for water heater performance changes over time.

8. The water heater system of claim 1, wherein the controller is further configured to issue an alert when the possible main gas valve non-closure condition is detected.

9. A heating assembly for use with a water heater having a water tank, the heating assembly comprising:

a main gas burner configured to heat water within the water tank;

a main gas valve configured to control a flow of gas to the main gas burner;

a pilot gas burner disposed proximate the main gas burner such that the pilot gas burner is positioned to ignite the main gas burner;

a water temperature sensor configured to be thermally coupled to water within the water tank, the water temperature sensor outputting a water temperature signal representative of a sensed water temperature within the water tank;

a thermopile having a first portion positioned proximate a pilot flame produced by the pilot gas burner and a second portion positioned proximate a main burner flame produced by the main gas burner, the thermopile outputting a thermopile signal that is representative of a temperature difference between the first portion of the thermopile and the second portion;

a controller operably coupled with the main gas valve and configured to receive the thermopile signal from the thermopile and the water temperature signal from the water temperature sensor, the controller configured to cycle the main gas burner ON when the sensed water temperature falls to a temperature set point minus a dead band, and to cycle the main gas burner OFF when the sensed water temperature reaches the temperature set point;

wherein after the sensed water temperature reaches the temperature set point, and the controller cycles the main gas burner OFF, the controller is configured to monitor for a possible main gas valve non-closure condition where: (1) the sensed water temperature continues to rise; and (2) the thermopile signal from the thermopile reaches a stable state, and when the possible main gas valve non-closure condition is detected, the controller is configured to toggle the main gas valve ON and determine whether the thermopile signal from the thermopile changes from the stable state or not by at least a predetermined amount.

10. The heating assembly of claim 9, wherein:

when the thermopile signal from the thermopile changes from the stable state by the predetermined amount, the controller is configured to: (1) lower the temperature set point; (2) increase a temperature cutoff temperature (TCO) in which the controller shuts down the main gas valve after the sensed water temperature reaches the TCO; and/or (3) increase the time that the sensed water temperature must remain above the TCO before the controller shuts down the main gas valve; and when the thermopile signal from the thermopile does not change from the stable state by the predetermined amount, the controller is configured to shut down the main gas valve.

11. The heating assembly of claim 9, wherein when the possible main gas valve non-closure condition is detected, the controller is configured to toggle the main gas valve ON for a predetermined period of time before toggling the main gas valve OFF.

12. The heating assembly of claim 9, wherein when the possible main gas valve non-closure condition is detected, the controller is configured to toggle the main gas valve ON for a predetermined period of time regardless of whether there is a call for heat before toggling the main gas valve OFF.

13. The heating assembly of claim 9, wherein the pilot gas burner comprises an intermittent pilot, and wherein the intermittent pilot is turned ON when the controller is monitoring for the possible main gas valve non-closure condition.

14. The heating assembly of claim 9, wherein the controller is further configured to:

store a steady state ON value for the thermopile signal at a time when the main gas burner is ON for an extended time;

store a steady state OFF value for the thermopile signal at a time when the main gas burner is OFF for an extended time with only the pilot gas burner ON;

use the steady state OFF value and the steady state ON value to interpolate and/or extrapolate to a current position of the main gas valve based on the current the thermopile signal.

15. The heating assembly of claim 14, wherein the controller is further configured to periodically update the steady state ON value and the steady state OFF value in order to compensate for water heater performance changes over time.

16. The heating assembly of claim 9, wherein the controller is further configured to issue an alert when the possible main gas valve non-closure condition is detected.

17. A control module for a heating assembly of a water heater with a water tank, wherein the heating assembly includes a main gas burner configured to heat water within the water tank, a main gas valve configured to control a flow of gas to the main gas burner, a pilot gas burner disposed proximate the main gas burner such that the pilot gas burner is positioned to ignite the main gas burner, a water temperature sensor configured to be thermally coupled to water within the water tank, the water temperature sensor outputting a water temperature signal representative of a sensed water temperature within the water tank, and a thermopile having a first portion positioned proximate a pilot flame produced by the pilot gas burner and a second portion positioned proximate a main burner flame produced by the main gas burner, the thermopile outputting a thermopile signal that is representative of a temperature difference between the first portion of the thermopile and the second portion, the control module comprising:

an output configured to provide control signals to the main gas valve;

a first input configured to receive the thermopile signal from the thermopile;

a second input configured to receive the water temperature signal from the water temperature sensor;

a controller operatively coupled to the output, the first input and the second input, the controller configured to cycle the main gas burner ON via the output when the sensed water temperature falls to a temperature set point minus a dead band, and to cycle the main gas burner OFF via the output when the sensed water temperature reaches the temperature set point;

wherein after the sensed water temperature reaches the temperature set point, and the controller cycles the main gas burner OFF, the controller is configured to monitor for a possible main gas valve non-closure condition where: (1) the sensed water temperature continues to rise; and (2) the thermopile signal from the thermopile reaches a stable state; and when the controller detects the possible main gas valve non-closure condition, the controller is configured to toggle the main gas valve ON via the output and determine whether the thermopile signal from the thermopile changes from the stable state or not by at least a predetermined amount.

18. The control module of claim 17, wherein:

when the thermopile signal from the thermopile changes from the stable state by the predetermined amount, the controller is configured to: (1) lower the temperature set point; (2) increase a temperature cutoff temperature (TCO) in which the controller shuts down the main gas valve after the sensed water temperature reaches the TCO; and/or (3) increase the time that the sensed water temperature must remain above the TCO before the controller shuts down the main gas valve; and when the thermopile signal from the thermopile does not change from the stable state by the predetermined amount, the controller is configured to shut down the main gas valve.

19. The control module of claim 17, wherein when the possible main gas valve non-closure condition is detected, the controller is configured to toggle the main gas valve ON for a predetermined period of time before toggling the main gas valve OFF.

20. The control module of claim 17, wherein when the possible main gas valve non-closure condition is detected, the controller is configured to toggle the main gas valve ON for a predetermined period of time regardless of whether there is a call for heat before toggling the main gas valve OFF.

* * * * *